US005246567A

United States Patent [19]

Buttke et al.

[11] Patent Number: 5,246,567

[45] Date of Patent: Sep. 21, 1993

[54] BENZENE REMOVAL IN AN ISOMERIZATION PROCESS

[75] Inventors: Robert D. Buttke; Frank S. Modica, both of Naperville, Ill.; Bruce A. Fleming, Ogden Dunes, Ind.

[73] Assignee: Amoco Corporation, Chicago, Ill.

[21] Appl. No.: 832,968

[22] Filed: Feb. 10, 1992

[51] Int. Cl.[5] ..... C10G 69/02

[52] U.S. Cl. ..... 208/49; 208/66; 208/65; 208/144

[58] Field of Search ..... 585/254, 258, 734, 750; 208/144, 65, 49, 66

[56] References Cited

U.S. PATENT DOCUMENTS

| | | | |
|---|---|---|---|
| 2,428,692 | 10/1947 | Voorhies, Jr. | 585/734 |
| 2,953,606 | 9/1960 | Dean et al. | 585/258 |
| 3,420,769 | 1/1969 | Manne | 208/144 |
| 3,533,937 | 10/1970 | Stankis | 208/144 |
| 3,848,018 | 11/1974 | Robson | 585/734 |
| 4,834,866 | 5/1989 | Schmidt | 208/66 |
| 5,003,118 | 3/1991 | Low et al. | 585/734 |
| 5,059,741 | 10/1991 | Foley | 585/734 |
| 5,146,037 | 9/1992 | Zarchy et al. | 585/734 |

*Primary Examiner*—Helane Myers

*Attorney, Agent, or Firm*—Thomas A. Yassen; Richard A. Kretchmer; Frank J. Sroka

[57] ABSTRACT

A process is provided for the hydrogenation of benzene and the isomerization of a light naphtha feedstock consisting essentially of a stream having a boiling range of from about 50° F. to about 240° F. comprising the steps of contacting the light naphtha feedstock at isomerization conditions in an isomerization reaction zone with an isomerization catalyst in the presence of hydrogen and producing an isomerization reaction zone effluent, combining the isomerization reaction zone effluent with a supplemental benzene-containing stream comprising at least 1 weight percent benzene and forming a hydrogenation zone feedstock, and hydrotreating the hydrogenation zone feedstock at hydrogenation conditions in a hydrogenation reaction zone with a hydrogenation catalyst in the presence of hydrogen for producing an isomerate product comprising less than 0.1 weight percent benzene.

35 Claims, 2 Drawing Sheets

BENZENE REMOVAL IN AN ISOMERIZATION PROCESS

BACKGROUND OF THE INVENTION

This invention relates to a process for the removal of benzene from petroleum fuels and gasoline. More particularly, this invention relates to a process for the controlled hydrogenation benzene utilizing a light naphtha isomerization process.

Largely paraffinic crude naphtha fractions, generally comprising $C_4$ to $C_{12}$ hydrocarbons and having a boiling point generally below 425° F. at atmospheric conditions, are a significant source of gasoline pool blending components. As produced from a refinery crude unit or pipestill, these paraffinic crude naphtha fractions have a low octane rating and without upgrading or blending with a higher octane stream, can comprise only a small fraction of the finished gasoline pool. Historically, the addition of lead was useful for upgrading gasoline pool octane, permitting the blending of higher amounts of low octane paraffinic crude naphtha directly into finished gasoline. However, lead phase-out eliminated this as a cost-effective alternative to enhance gasoline pool octane.

Refiners now commonly utilize downstream processing steps to enhance paraffinic crude naphtha octane. Paraffinic naphtha fractions comprising $C_7$ to $C_{12}$ hydrocarbons are generally reformed into higher octane aromatics by a combination of dehydrogenation and dehydrocyclization. The reformate product produced from such reforming processes, comprising aromatics such as benzene, toluene, and xylene, can also be separated from the gasoline pool and marketed as feedstock for chemical manufacture or sold in component form to other refiners as octane support. The reforming process also manufactures hydrogen as a by-product, which has become particularly useful to refiners who now must meet ever decreasing fuels sulfur level targets.

Paraffinic naphtha fractions comprising $C_4$ to $C_6$ hydrocarbons, and more particularly comprising $C_5$ to $C_6$ hydrocarbons (light paraffinic naphtha), are generally isomerized in an isomerization process to higher octane branched isoparaffins. Isomerization is generally preferred to reforming for paraffinic $C_5$ hydrocarbons since such hydrocarbons are not easily reformed into aromatics. Isomerization of paraffinic $C_6$ hydrocarbons is generally preferred to reforming since the reforming of such hydrocarbon results in a lower reformate volume yield than typical of reformate produced from $C_7$ to $C_{12}$ hydrocarbons, wherein the octane benefits derived from reforming are outweighed by the loss of gasoline volume yield.

The isomerization of $C_5$ to $C_6$ paraffinic naphtha fractions is generally believed to be a first-order reversible reaction that is constrained by thermodynamic equilibrium between the normal paraffinic feedstock and the various isomers of the feedstock. Most isomerization processes are categorized as either low-temperature or high-temperature isomerization. Low-temperature isomerization processes generally utilize a highly-chlorided platinum on alumina catalyst which provides high catalyst activity and permits operation at lower temperatures. High-temperature isomerization processes typically utilize a catalyst containing platinum or other noble metals on a molecular sieve-based support which provides lower catalyst activity and necessitates operation at higher temperatures. Both processes utilize catalysts of sufficient activity to generate undesirable side-reactions such as disproportionation and cracking. These side-reactions combined with paraffinic naphtha dehydrogenation, not only decrease the product yield but can form olefinic components that increase catalyst deactivation. These undesired reactions are generally controlled by carrying out the isomerization reaction in the presence of a hydrogen-containing stream.

New clean air legislation, which substantially reduces the allowable benzene content in gasoline, may necessitate significant changes in the management of $C_4$ to $C_{12}$ paraffinic naphtha fractions. Although refiners can target reformer feed streams to contain substantially $C_7$ to $C_{12}$ components, modern fractionation processes generally result in some percentage of paraffinic $C_6$ hydrocarbon remaining in the reformer feed, wherein such hydrocarbon is subsequently reformed to benzene and other reaction products. Where fractionation steps are adjusted to ensure only minimal paraffinic $C_6$ hydrocarbons enter the reformer feed, such as by increasing the temperature cut point between isomerization unit feed and reformer feed, additional volumes of $C_7$ hydrocarbons are fractionated into isomerization unit feed. Hydrocarbons having 7 carbons or more are known to substantially increase the deactivation rate of modern isomerization unit catalysts and are more susceptible to hydrocracking, resulting in a reduction in liquid yield and high reaction temperature exotherms. Moreover, some $C_6$ hydrocarbons are formed from the hydrocracking of higher boiling hydrocarbon in the reforming process and subsequently reformed to benzene. Such benzene production cannot be avoided by improved fractionation techniques. Additionally, benzene has a relatively high octane number, and processing steps to destroy or limit production of any high octane component, may necessitate the replacement of the lost octane through more costly processing alternatives.

Therefore, there is a great need in the petroleum refining industry, for a cost effective, safe, and operationally controllable method for reducing the benzene content in gasoline. Several methods have been suggested to address the aforementioned need, each meeting with varying degrees of success.

Saturation of benzene by processing a benzene-containing stream directly over an isomerization catalyst, has been utilized to reduce benzene concentrations where small concentrations of benzene are involved. This process generally requires fractionation of $C_5$ to $C_6$ paraffinic naphtha streams derived from crude, in a manner so as to include a substantial portion of the $C_5$ and $C_6$ cyclics (including benzene) in the isomerization unit feed stream. The isomerization unit feed stream can also be supplemented with $C_6$ cyclics manufactured in other refining facilities, including but not limited to catalytic reforming processes, and processed directly into an isomerization unit. With the hydrogen that is present in the isomerization unit reaction zone and the high activity of the isomerization catalyst, substantially all of the benzene is quickly hydrogenated.

U.S. Pat. No. 4,834,866 to Schmidt teaches such a conversion process for feedstocks comprising $C_4$ hydrocarbon to hydrocarbon boiling at a temperature of about 400° F. ($C_{12}$) which includes a fractionating step upstream of the isomerization reactors for separating the feedstock into an overhead stream comprising methyl pentane and hydrocarbon boiling at a temperature lower than methyl pentane, a side cut stream comprising hydrocarbon boiling at a temperature higher than methyl pentane and lower than cyclohexane or benzene, and a bottoms stream comprising hydrocarbon boiling at a temperature higher than cyclohexane or benzene. The side cut fraction is sent to an isomerization zone where the normal hexane is isomerized and substantially all of the benzene saturated. The product of the isomerization reactors is recycled back to the fractionating step where the isoparaffins can be removed to the overhead stream and the unconverted materials, including any unconverted benzene, recycled to extinction through the side cut fraction.

While benzene saturation processes, utilizing a paraffinic naphtha isomerization zone, are particularly effective for converting benzene to an environmentally more acceptable form, there are substantial processing penalties. Cyclic hydrocarbons present or formed in an isomerization unit reaction zone are generally adsorbed into the isomerization catalyst. Adsorption of cyclic compounds on the active sites of the catalyst generally inhibits normal paraffin isomerization resulting in a reduction in conversion of normal paraffins to their respective isomers and a reduction in isomerate product octane.

Apart from the conversion inefficiencies caused by processing $C_5$ to $C_6$ cyclics in an isomerization reaction zone, the saturation of benzene is highly exothermic. The saturation of benzene in a feedstream generally results in a feedstream temperature increase or exotherm across the isomerization reaction zone of about 20° F. per weight percent benzene in the feedstream. For purposes of the present invention, reaction zone exotherm shall be defined as the temperature difference between the reactor outlet temperature at a location where the exit pipe leaves the reactor (reactor outlet) and the reactor inlet temperature at a location where the inlet pipe enters the reactor (reactor inlet), for the reactor within the reaction zone having the largest reaction zone exotherm. High isomerization reaction temperatures are generally unfavorable since they inhibit the formation of more desirable higher octane doubly branched isomers and result in lower yields of high octane isomers such as 2,2-dimethylbutane (J. A. Ridgeway, Jr. and W. Schoen, ACS Symposium, Div. of Petroleum Chemistry, Boston, Apr. 5–10, 1959, A-5-A-11). Higher reaction zone temperatures similarly increase the rate of carbon laydown (coking) on the catalyst resulting in catalyst deactivation.

It is also known that benzene can be converted to more environmentally acceptable forms through hydrogenation in a separate reaction step upstream of an isomerization zone.

U.S. Pat. No. 5,003,118 to Low et al. teaches a process for hydrogenation and decyclization of benzene which requires passing an isomerization unit feedstream, including all of the benzene, over a hydrogenation catalyst comprising either a platinum group metal and tin on a solid support or a platinum group metal and cobalt and molybdenum on a solid support. The hydrogenated product is then directed, without additional heat input, to an isomerization zone where the hydrogenated product is isomerized and an isomerate product produced. The Low et al. process utilizes the heat derived from saturating benzene as the entire heat source for obtaining the isomerization zone operating temperature.

While the Low et al. process effectively mitigates the penalties associated with benzene adsorption on the isomerization reaction zone catalyst, other cyclics which are derived from the saturation of benzene, such as cyclohexane and methylcyclopentane, are still directed to the isomerization reaction zone resulting in less effective isomerization. Moreover, there are several drawbacks to processes which rely on a benzene hydrogenation exotherm for providing optimum isomerization reaction zone temperatures. Isomerization facilities generally process a feedstock fractionated directly from petroleum crude. The benzene concentration of the petroleum crude-derived light paraffinic naphtha can vary substantially, causing wide variations in the benzene hydrogenation exotherm. Where there is no supplemental or controlling heating or cooling source between the hydrogenation and isomerization reaction zones, the isomerization reaction zone temperature cannot be regulated optimally or even reliably.

Large swings, and particularly upward excursions in the hydrogenation reaction zone temperature can also cause hydrocracking to occur in the hydrogenation or isomerization reaction zones and a subsequent hydrogenation or isomerization reaction zone temperature runaway condition. Higher hydrogenation or isomerization reaction zone temperatures increase hydrocracking, which increases the yield of undesirable lighter hydrocarbons at the expense of liquid products. It is important to note that hydrocracking is also a highly exothermic reaction. Deviations in the concentration of benzene in isomerization unit feedstreams can cause significant hydrocracking to occur in modern isomerization units, compounding the benzene saturation exotherm with a hydrocracking exotherm, and resulting in a temperature runaway condition. A temperature runaway scenario generally deactivates the isomerization catalyst resulting in severe process penalties, and under more extreme situations, can result in damage to equipment, potential unit shutdown, and can present a safety hazard to facility personnel.

Aside from the cost penalties associated with loss of optimum process control, processes similar to those described above are limited as to the capacity of benzene processed. Since benzene hydrogenation capacity is generally exotherm limited to a particular concentration of benzene in the feedstock, benzene that is naturally occurring in the crude-derived paraffinic naphtha feedstock limits the volume of supplemental benzene (at a higher benzene concentration) that can be added from other refinery processes before reaching the exotherm limit. Therefore, processes utilizing a separate benzene hydrogenation zone upstream of an isomerization zone introduce a new array of process penalties and operability problems that must be eliminated or solved.

It has now been found that the addition of a benzene hydrogenation zone downstream of the isomerization zone of an isomerization unit combined with the addition of supplemental refinery benzene-containing streams downstream of the isomerization zone and upstream of a hydrogenation zone, provides superior operability and process economics to the prior art processes. Process penalties incurred from the adsorption of benzene on the isomerization catalyst active sites through the addition of supplemental streams containing cyclics such as benzene are eliminated since supplemental benzene is added downstream of the isomerization zone. Benzene hydrogenation exotherms, temperature swings, and excessive hydrocracking caused by supplemental benzene sources generally do not adversely affect the isomerization reaction since hydrogenation of the benzene from the supplemental benzene sources occurs downstream of the isomerization reaction. Benzene processing capacity, at constant and controllable benzene hydrogenation exotherms, is also increased since the isomerization reaction zone product contains minimal benzene and provides a larger heat sink for absorbing the temperature exotherms created from the hydrogenation of benzene from supplemental sources.

It is therefore an object of the present invention to provide a process for the hydrogenation of benzene and the isomerization of a light naphtha feedstock that substantially reduces the benzene concentration of crude paraffinic naphtha fractions and supplemental high benzene-content streams processed in an isomerization facility.

It is another object of the present invention to provide a process for the hydrogenation of benzene and the isomerization of a light naphtha feedstock that achieves substantial benzene reduction wherein the benzene from supplemental benzene-containing streams does not significantly affect isomerization conversion or deactivate the isomerization catalyst.

It is another object of the present invention to provide a process for the hydrogenation of benzene and the isomerization of a light naphtha feedstock wherein exotherms created from the hydrogenation of benzene are controllable and do not create unstable exotherms that can cause operability problems, excessive hydrocracking, and temperature runaway conditions.

It is yet another object of the present invention to provide a process for the hydrogenation of benzene and the isomerization of a light naphtha feedstock that can process higher supplemental benzene-containing stream benzene concentrations and volumes at a constant and controllable exotherm temperature than prior art processes.

Other objects appear herein.

SUMMARY OF THE INVENTION

The above objects can be obtained by providing an integrated process for hydrogenating benzene and isomerizing a light naphtha feedstock consisting essentially of a stream having a boiling range of from about 50° F. to about 240° F. comprising the steps of contacting the light naphtha feedstock at isomerization conditions in an isomerization reaction zone with an isomerization catalyst in the presence of hydrogen and producing an isomerization reaction zone effluent, combining the isomerization reaction zone effluent with a supplemental benzene-containing stream comprising at least 1 weight percent benzene and forming a hydrogenation zone feedstock, and hydrotreating the hydrogenation zone feedstock at hydrogenation conditions in a hydrogenation reaction zone with a hydrogenation catalyst in the presence of hydrogen for producing an isomerate product comprising less than 0.1 weight percent benzene.

The benzene hydrogenation and light naphtha isomerization process of the present invention hydrogenates benzene present in crude paraffinic naphtha fractions and supplemental high benzene-content streams to levels less than 0.1 percent by weight as a percentage of the isomerization unit product and to levels generally less than 0.05 percent by weight as a percentage of the isomerization unit product. In this manner, benzene present in crude paraffinic naphtha and in supplemental benzene-containing streams such as those produced at catalytic reformers, is cost effectively converted to a more environmentally acceptable form.

The benzene hydrogenation and light naphtha isomerization process of the present invention achieves substantial benzene reduction wherein the benzene from supplemental benzene-containing streams does not significantly affect isomerization conversion or deactivate the isomerization zone catalyst. This is achieved by positioning the benzene hydrogenation reaction zone downstream of the isomerization reaction zone and injecting supplemental benzene-containing streams downstream of the isomerization reaction zone and upstream of the hydrogenation reaction zone. In this manner, benzene from supplemental benzene-containing streams generally does not contact the isomerization catalyst prior to hydrotreatment in the downstream hydrogenation reaction zone. In this manner, isomerization catalyst activity is preserved for converting normal paraffins to isoparaffins.

The benzene hydrogenation and light naphtha isomerization process of the present invention controls benzene hydrogenation exotherms by hydrogenating the benzene from the crude paraffinic naphtha stream, which is generally present in low concentrations, in an isomerization zone to create an isomerate product having minimal benzene. The isomerate product containing minimal benzene is then combined with a supplemental benzene-containing stream containing higher percentages of benzene for hydrogenation in a hydrogenation reaction zone. In this manner, the isomerate product provides an exotherm heat sink of known volume and composition (i.e. containing minimal benzene) for combining with the supplemental benzene-containing stream which can be more likely to vary in composition and volume. The rate of supplemental benzene-containing stream addition can then be adjusted to control temperature exotherms within an operating range to ensure that such exotherms do not cause operability problems, excessive hydrocracking, or a temperature runaway condition.

The benzene hydrogenation and light naphtha isomerization process of the present invention permits the processing of higher supplemental benzene-containing stream benzene concentrations and volumes at a constant and controllable exotherm temperature than prior art processes. This results from the hydrogenation of benzene contained in the crude paraffinic naphtha fractions, which is generally provided in low concentrations, in an isomerization reaction zone prior to hydrogenation of higher benzene content supplemental benzene-containing streams. Higher benzene concentrations and volumes of the supplemental benzene-containing stream can be processed since the product leaving the isomerization reaction zone and utilized as the heat sink for absorbing the exotherm contains minimal benzene. Additionally, the benzene concentration and volume of the isomerization zone product is generally known and permits increased supplemental benzene-containing stream processing capacity through improved process control.

In another embodiment, the above objects can be obtained by providing a process for the hydrogenation of benzene and the isomerization of a light naphtha feedstock consisting essentially of a stream having a boiling range of from about 50° F. to about 240° F. comprising the steps of contacting the light naphtha feedstock at isomerization conditions in an isomerization reaction zone with an isomerization catalyst in the presence of hydrogen and producing an isomerization reaction zone effluent substantially comprising normal paraffins and isoparaffins and less than about 0.1 weight percent benzene, combining the isomerization reaction zone effluent with a supplemental benzene-containing stream comprising at least 1 weight percent benzene and forming a hydrogenation zone feedstock substantially comprising normal paraffins, benzene, and isoparaffins, hydrotreating the hydrogenation zone feedstock at hydrogenation conditions in a hydrogenation reaction zone with a hydrogenation catalyst in the presence of hydrogen and producing a hydrogenation reaction zone effluent comprising normal paraffins, cycloparaffins, and isoparaffins and less than 0.1 weight percent benzene, separating the hydrogenation reaction zone effluent into a recycle stream substantially comprising normal paraffins and an isomerate product stream substantially comprising cycloparaffins and isoparaffins, and recycling the recycle stream back to the isomerization reaction zone.

In addition to the above advantages, the benzene hydrogenation and light naphtha isomerization process of the present invention, as described in this embodiment, provides normal paraffin separation and recycle steps that substantially improve normal to isoparaffin conversion. Normal paraffins that are not converted to isoparaffins from the crude paraffinic naphtha and normal paraffins from the supplemental benzene-containing stream can be separated downstream of the hydrogenation reaction zone and recycled back to the isomerization reaction zone for isomerization to higher octane isomers. In this manner, the process of the present invention provides maximum isomerization capability and produces a product containing minimal benzene.

BRIEF DESCRIPTION OF THE INVENTION

Figure 1:
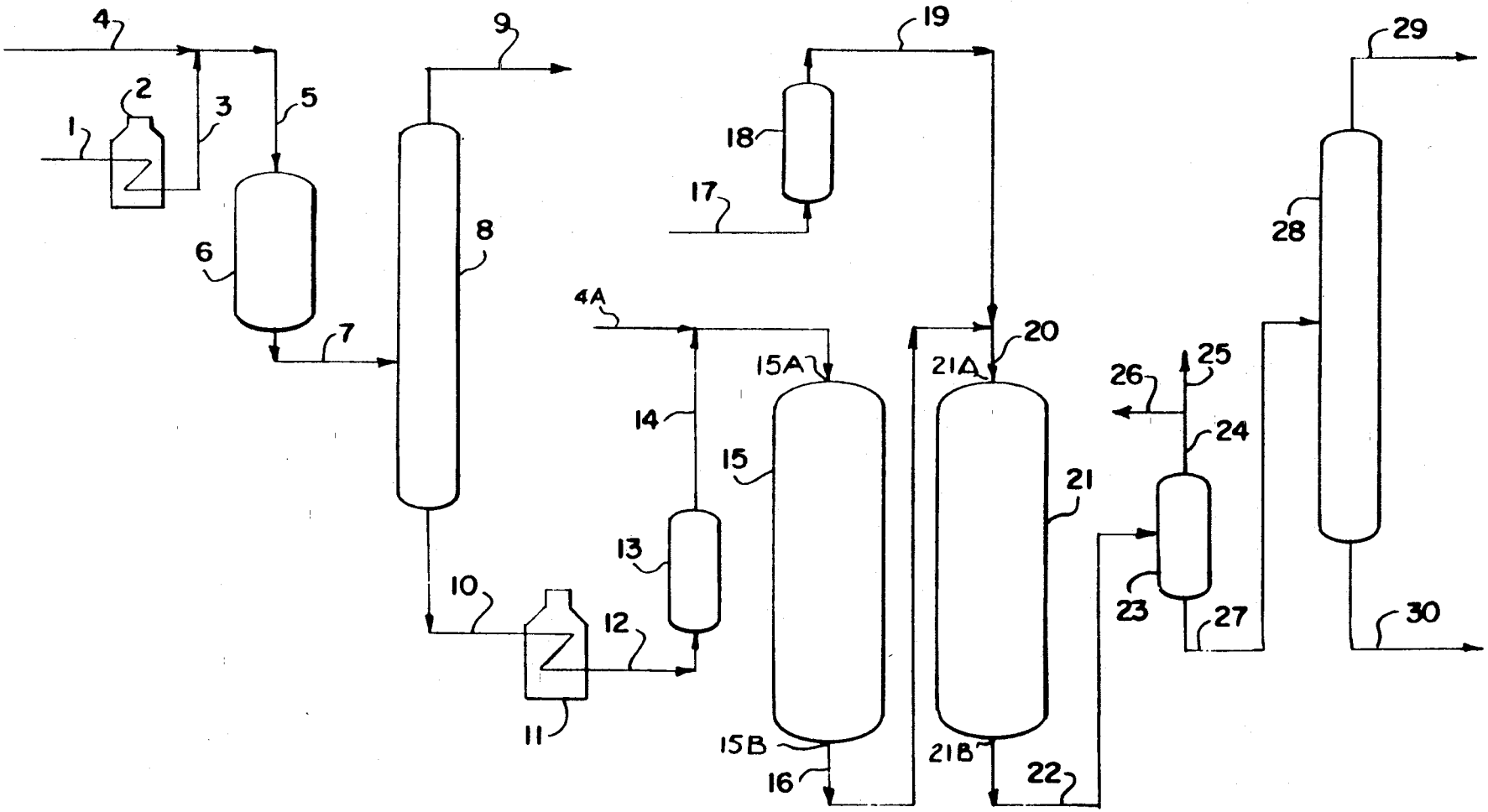
FIG. 1 illustrates an embodiment of the benzene hydrogenation and light naphtha isomerization process of the present invention utilizing a once-through isomerization process.
Figure 2:
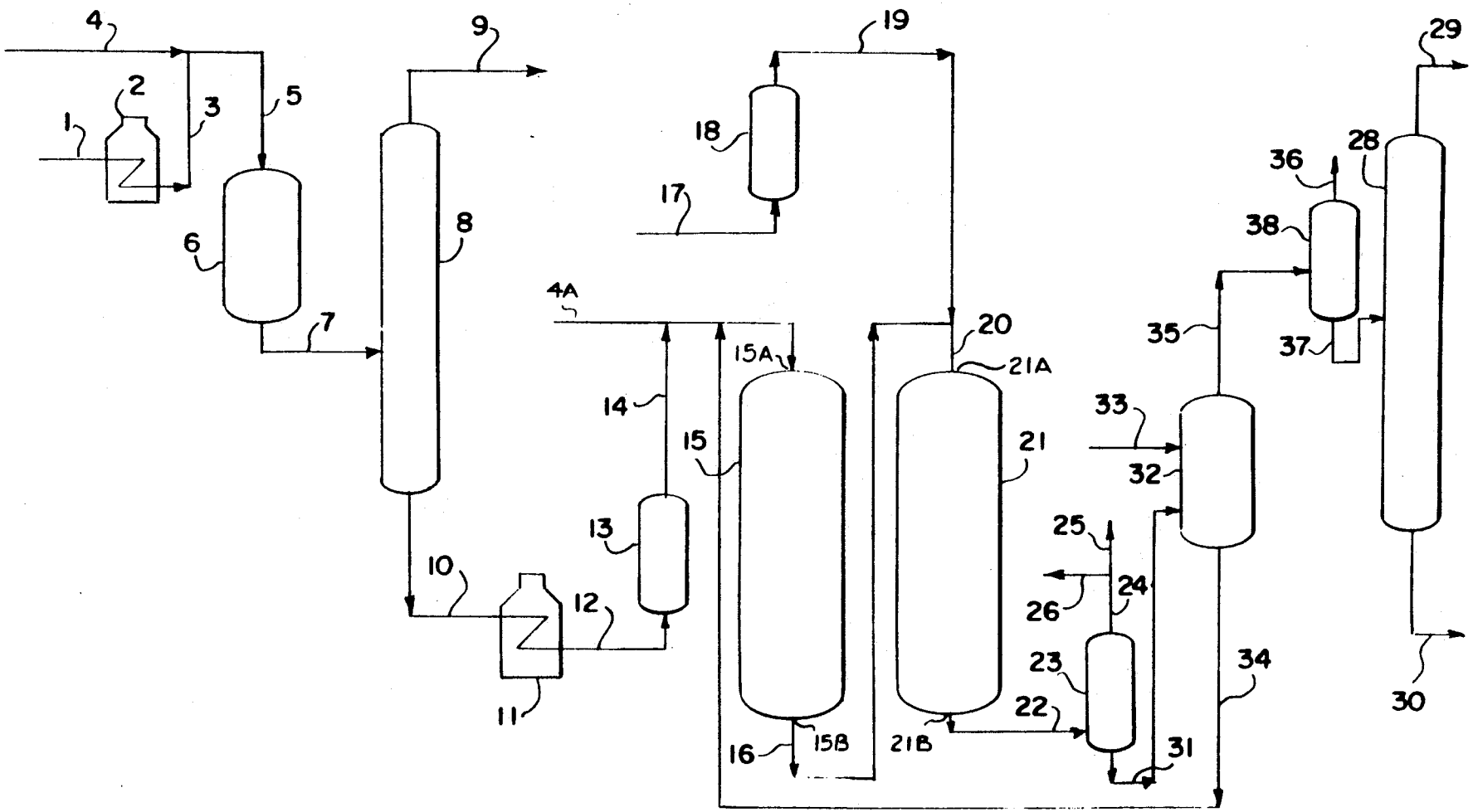
FIG. 2 illustrates an embodiment of the benzene hydrogenation and light naphtha isomerization process of the present invention utilizing a recycle isomerization process.

A basic arrangement for the processing equipment used in the present invention can be readily understood by a review of the process flow diagrams presented in FIGS. 1 and 2. FIG. 1 utilizes the present invention with a once-through isomerization process and FIG. 2 utilizes the present invention with a recycle isomerization process. Since the embodiments of FIGS. 1 and 2 are similar, the equipment is identified using the same equipment identification numbers and the process flow diagrams are described for both FIGS. 1 and 2 simultaneously, to the extent applicable. The Figures and this description make no mention of pumps, compressors, heat exchangers, instrumentation, and other well-known items of processing equipment in order to simplify the explanation of the invention.

Referring to FIGS. 1 and 2, a light naphtha isomerization unit feedstock comprising $C_5$ and $C_6$ paraffins enters the process through line 1 where the feedstock is heated to feedstock desulfurization conditions in furnace 2 and discharged to furnace transfer line 3. The heated feedstock from transfer line 3 is combined with hydrogen from hydrogen conduit 4 and conveyed through desulfurizer feed line 5 to a desulfurizer reactor 6. The feedstock is hydrogenated and desulfurized in the desulfurizer reactor 6 to remove catalyst poisons such as sulfur and nitrogen. The desulfurizer reactor effluent is discharged through desulfurizer reactor effluent line 7 to a desulfurizer stripper tower 8 where hydrogen, light hydrocarbon, hydrogen sulfide, and ammonia present or formed in the desulfurizer reactor 6 are removed from the desulfurized feedstock through stripper tower 8 overhead line 9. The desulfurized feedstock is removed from the stripper tower 8 through stripper bottoms line 10 for conveying for isomerization.

The desulfurized feedstock from stripper bottoms line 10 is processed through isomerization feed preheat furnace 11 for preheating to isomerization conditions and discharged to furnace transfer line 12. The heated isomerization feed from transfer line 12 is directed to sulfur guard vessel 13 where trace sulfur is removed from the isomerization feed. The sulfur guard vessel effluent product is directed to conduit 14 as isomerization reactor feed. Hydrogen from conduit 4A is added to the isomerization reactor feed and the hydrogen and isomerization reactor feed from conduit 14 is directed to isomerization reactor 15, defining a reactor inlet 15A and a reactor outlet 15B, where the desulfurized feedstock comprising $C_5$ and $C_6$ normal paraffins is isomerized, in the presence of hydrogen, to higher octane isomers. The effluent from the isomerization reactor 15 is discharged to isomerate effluent conduit 16 for directing for benzene hydrogenation.

A supplemental benzene-containing stream comprising benzene is directed through conduit 17 to sulfur guard vessel 18 where trace sulfur is removed from the supplemental benzene-containing stream prior to hydrogenation. The supplemental benzene-containing stream exits the sulfur guard vessel 18 through conduit 19 where the supplemental benzene-containing stream is combined with the isomerate effluent from conduit 16 through hydrogenation reactor feed line 20 to form hydrogenation reactor feed. The hydrogenation reactor feed from reactor feed line 20 is directed to hydrogenation reactor 21, defining a reactor inlet 21A and a reactor outlet 21B, where the benzene from the supplemental benzene-containing stream and any benzene remaining from the light naphtha isomerization feed is hydrogenated to components including cyclohexane and methylcyclopentane. The hydrogenated product is directed from hydrogenation reactor 21 to hydrogenation reactor effluent conduit 22 for directing to downstream processing facilities.

The hydrogenated product from effluent conduit 22 is directed to a hydrogen flash separator 23 where hydrogen and light hydrocarbon are separated from the hydrogenated product and leave the flash separator 23 through flash separator overhead conduit 24. Some of the hydrogen from conduit 24 is recycled back to the process or to other hydrogen processes through hydrogen recycle line 26. Sections of the process that can utilize recycle hydrogen include, but are not limited to, the desulfurizer, isomerization, or benzene hydrogenation sections of the process. The remaining hydrogen from conduit 24 is purged to a spill system through hydrogen spill conduit 25, generally provided to maintain hydrogen recycle stream purity.

In the once-through isomerization process illustrated in FIG. 1, the hydrogenated product exits the hydrogen flash separator 23 through conduit 27 and is stabilized in fractionator 28 to remove light hydrocarbon that can cause high gasoline component vapor pressure and that is more profitably recovered to other refinery hydrocarbon pools. The fractionator 28 overhead line 29 directs light hydrocarbon to other hydrocarbon pools such as propane or butane recovery, fuel, or other conversion processes for light hydrocarbon. The stabilized isomerate product exiting the fractionator 28 is conveyed to gasoline blending or other downstream operations through fractionator bottoms conduit 30.

In the recycle isomerization process illustrated in FIG. 2, the hydrogenated product exits the hydrogen flash separator 23 through conduit 31 where the hydrogenated product is directed to normal paraffin separation means 32 provided for separating unconverted normal paraffins from the higher octane isomers. A high-purity hydrogen stream is added to the normal paraffin separation means 32 through hydrogen conduit 33 to facilitate separation. The normal paraffins and hydrogen are recycled back to conduit 14 through normal paraffin recycle line 34 where the normal paraffins can be reprocessed to higher octane isomers in the isomerization reactors. The stream comprising higher octane isomers and any remaining hydrogen exit the normal paraffin separation means 32 through outlet conduit 35 where the stream is directed to hydrogen flash separator 38. Hydrogen is separated from the stream comprising higher octane isomers and hydrogen in the hydrogen flash separator 38 wherein the hydrogen exits the separator through overhead hydrogen line 36. The hydrogenated stream comprising higher octane isomers exits the hydrogen flash separator through conduit 37 and is stabilized in fractionator 28 as previously described hereabove for the once-through process described in FIG. 1.

The light naphtha feedstock processed in the isomerization process of the present invention is generally light straight run or light virgin naphtha which is derived directly from crude after a crude distillation or fractionation step. The feedstock may also include debutanized natural gasoline (DNG) which can be obtained commercially as an intermediate feedstock. Light naphtha feedstock can also be obtained from other refinery processes including, but not limited to a catalytic reformer, where fractionation inefficiencies or cracking has resulted in the production and separation of light paraffinic hydrocarbon from the product of the process.

The light naphtha feedstock generally comprises a paraffinic naphtha fraction comprising $C_4$ to $C_6$ hydrocarbons, and more particularly $C_5$ to $C_6$ aliphatic hydrocarbons. The light naphtha feedstock concentration of aliphatic hydrocarbons having 5 to 6 carbons atoms suitable for use with the present invention is generally at least about 75 percent by weight, preferably at least about 85 percent by weight, and more preferably at least about 90 percent by weight for best results. The light paraffinic naphtha feedstock consists essentially of hydrocarbon possessing a boiling point range of from about 50° F. to about 210° F. at atmospheric pressure wherein the term "consisting essentially of" is defined as at least volume 90 perfect of the light naphtha feedstock.

Light naphtha feedstock components outside of the preferred operating compositional ranges are generally processed with an associated cost penalty. Feed components having 4 carbon atoms or less generally pass through the process with little beneficial conversion. Some conversion from normal to isobutane can occur, however the adverse effects of reduction of reactor space velocity and resultant loss of approach towards reaction thermodynamic equilibrium for the normal pentane and normal hexane streams generally outweigh the benefits of this normal butane conversion to isobutane.

Components having 7 carbon atoms or more adversely affect the isomerization reaction by inhibiting the normal pentane and normal hexane isomerization reaction, thereby resulting in an isomerate product having a lower octane number. In addition, as much as 70 percent by weight of the $C_7$ and heavier hydrocarbon can be deleteriously hydrocracked to low value propane and butane. The exotherm from hydrocracking $C_7$ and heavier hydrocarbon presents additional cost and operability penalties.

Cyclic components can also adversely effect the isomerization reaction and should be minimized. The presence of cyclics such as benzene, methylcyclopentane, and cyclohexane strongly inhibit the isomerization reaction to high octane isomers by the adsorption of these components on the catalyst acid sites. Benzene also creates a significant isomerization reaction exotherm through aromatic hydrogenation, which increases the average reaction temperature, resulting in undesirably lower selectivity to higher octane isomers. Therefore, the cyclic hydrocarbon components in the isomerization unit feed are preferably limited to not more than about 10 percent by weight, preferably not more than about 7.5 percent by weight, and more preferably not more than about 5 percent by weight for best results. The light naphtha feedstock generally comprises benzene in an amount ranging from about 0.1 weight percent to about 6 weight percent, typically from about 1 weight percent to about 5 weight percent, more typically from about 2 weight percent to about 5 weight percent, and commonly from about 3 weight percent to about 5 weight percent.

Olefinic components are generally adverse to the isomerization reaction and should be minimized. High concentrations of olefinic components increase carbon laydown (coking) resulting in catalyst deactivation. Moreover, olefins are generally hydrogenated in the isomerization process. This olefinic hydrogenation reaction is exothermic and unfavorably increases the isomerization reaction temperature. Additionally, olefins boiling in the light naphtha boiling range generally have a higher octane than corresponding normal and isoparaffins boiling in the light naphtha boiling range. Preferably, the olefin concentration of the isomerization reactor feedstock should be minimized at less than about 10 percent by weight, preferably less than about 8 percent by weight, and more preferably, less than about 5 percent by weight for best results.

Catalyst poisons such as nitrogen, sulfur, and water should also be kept at a minimum in order to prevent catalyst deactivation. Many operating facilities are equipped with hydrotreater sections within the isomerization complex to reduce nitrogen and sulfur contaminant levels in the feedstock prior to introduction into the isomerization reactors. Generally, isomerization reactor feed should contain less than about 3 ppm by weight of nitrogen and less than about 3 ppm by weight of sulfur, preferably less than about 2 ppm by weight of nitrogen and less than about 2 ppm by weight of sulfur, and more preferably less than about 1 ppm by weight of nitrogen and less than about 1 ppm by weight of sulfur for best results. Regenerative molecular sieve driers can be provided to minimize water content in the isomerization reactor feed. Isomerization reactor feed should contain less than about 250 ppm by weight water, preferably less than about 100 ppm by weight water, and more preferably less than about 50 ppm by weight water for best results. Low temperature process catalysts can necessitate lower concentrations of water.

The supplemental benzene-containing stream processed in the isomerization process of the present invention is generally a concentrated benzene-containing hydrocarbon stream, generally derived directly from crude or produced in catalytic processes. Where the supplemental benzene-containing stream comprises components derived directly from crude, a benzene precursor stream is generally fractionated directly from crude or from the mix of feedstocks generally directed to the reformer. The precursor stream generally comprises hydrocarbons having 6 carbon atoms which, at reforming conditions, would be converted, in some amount, to benzene.

The most common source of supplemental benzene-containing streams is a catalytic reforming process wherein paraffinic naphtha fractions comprising $C_7$ to $C_{12}$ hydrocarbons are reformed into higher octane aromatics by a combination of dehydrogenation and dehydrocyclization. Since it is common for paraffinic $C_6$ hydrocarbons to enter the reforming process with the $C_7$ to $C_{12}$ hydrocarbon feedstock and similarly common for some $C_6$ paraffinic hydrocarbon to be formed from the cracking of hydrocarbons having 7 or more carbon atoms in the reforming process, benzene is common in the reformate product. The supplemental benzene-containing steam is concentrated by fractionating benzene and hydrocarbon boiling at a lower temperature than benzene from the reformate product. In this manner, reformer generated supplemental benzene-containing streams generally comprise more than 1 weight percent benzene calculated as a percentage of the benzene-containing stream, typically more than 3 weight percent benzene, commonly more than 5 weight percent benzene, and often more than 8 weight percent benzene.

The supplemental benzene-containing stream can also comprise benzene derived from cracking processes such as a fluid catalytic cracking unit or a coking unit. The products from such processes, however, can possess components that are undesirable when contacted with an isomerization catalyst such as olefins, sulfur, nitrogen, and hydrocarbons having 7 or more carbon atoms. Where the supplemental benzene-containing stream is processed in a once-through isomerization process such as that illustrated in FIG. 1 wherein hydrogenated product derived from the cracked supplemental benzene-containing stream is not recycled back to the isomerization reactors, the presence of undesirable components in the supplemental benzene-containing stream becomes of less importance. However, where the isomerization process is a recycle isomerization process such as that illustrated in FIG. 2 and some of the hydrogenation reaction zone products are recycled back to the isomerization reaction zone, the contaminants should be removed or factored into the process economics developed for considering the processing of such a stream.

Contaminants such as sulfur and nitrogen should be substantially minimized prior to addition of the supplemental benzene-containing stream to the hydrogenation reaction zone since the hydrogenation reaction zone catalyst can be subject to sulfur and nitrogen poisoning. Hydrogen, ammonia, and hydrogen sulfide derived from sulfur and nitrogen removal processes such as desulfurizers, should also be removed prior to addition of the supplemental benzene-containing stream to the hydrogenation zone. Supplemental benzene-containing stream components such as reformate from a catalytic reforming process are generally desulfurized and denitrogenated in the reforming process and do not require subsequent hydrogenation. Olefin removal from cracked benzene-containing streams can be more costly. Olefin removal steps can include saturation of olefins to paraffins. However, the saturation of olefins incurs high processing costs and can result in a loss of product octane since olefins in the $C_5$ to $C_6$ boiling range generally have a higher octane than isoparaffins. A more profitable mechanism for olefin removal from cracked benzene-containing streams includes total isomerization of the $C_5$ to $C_6$ olefins to iso-olefins and subsequent etherification to oxygenated products such as TAME. The high octane ethers can be fractionated from the normal and isoparaffins and cyclics (including benzene) in the benzene-containing stream by boiling point. In this manner, a high octane ether can be recovered from the olefins for blending to finished gasoline and an additional source of benzene eliminated through the isomerization process of the present invention.

Another source of supplemental benzene-containing streams can also be the off-test or unsaleable benzene volumes produced or marketed through chemical plant operations. A wide variety of benzene-containing streams can be processed in the process of the present invention provided that the benzene and other contaminants present in the supplemental benzene-containing stream are monitored and removed or controlled as described above so as not to uneconomically disrupt the isomerization process.

The isomerization catalyst suitable for use with the process of the present invention is generally one of two particular classes of isomerization catalyst; a low temperature isomerization catalyst or a high temperature isomerization catalyst. Each class of isomerization catalyst comprises a catalytic metal and a support component. Both classes of isomerization catalysts generally comprise a catalytic metal comprising a noble metal (IUPAC), preferably a platinum group metal, and more preferably platinum for best results. The isomerization catalyst can similarly comprise a combination of two or more metals selected from the above groups. The catalytic metal may exist within the final catalytic composite as an oxide or halide or as an elemental metal. The catalytic metal in either class of isomerization catalyst suitable for use with the process of the present invention is generally present in an amount ranging from about 0.01 percent by weight to about 5.0 percent by weight, preferably from about 0.1 percent by weight to about 2.0 percent by weight, and more preferably from about 0.2 percent by weight to about 1.0 percent by weight, calculated as a percentage of the isomerization catalyst.

The isomerization catalyst support suitable for use with a low temperature isomerization process is generally an adsorptive carrier promoted with a halogen or boron. A particularly common low temperature isomerization catalyst support utilizes an alumina carrier promoted with a minor amount of chloride. The alumina is preferably an anhydrous gamma-alumina or eta alumina with a high degree of purity. The low temperature catalyst support can also contain a larger amount of chloride component wherein the chloride component is present in the catalyst support in an amount ranging from about 2 weight percent to about 15 weight percent and more preferably in an amount ranging from about 5 weight percent to about 15 weight percent.

The isomerization catalyst support suitable for use with a high temperature isomerization process is generally a molecular sieve support typically comprising a crystalline aluminosilicate support diluted with an inorganic binder. The molecular sieve supported isomerization catalysts, and particularly mordenite, are well known and described in detail in U.S. Pat. Nos. 3,299,153, 3,442,794, 3,527,835, and 3,836,597, which are hereby incorporated by reference. Other examples of catalysts used in high temperature processes are disclosed in U.S. Pat. No. 3,236,903 where the catalyst is a zeolite molecular sieve containing a catalytically active metal such as rhodium and U.S. Pat. Nos. 3,236,761, 3,236,762, and 3,354,077 where the catalyst is a Y-type crystalline zeolite containing a Group VIII metal. The zeolitic support can also comprise beta zeolite.

The molecular sieve component of the high temperature isomerization catalyst generally comprises from about 50 percent by weight to about 99.9 percent by weight of the catalyst support, preferably from about 60 percent by weight to about 90 percent by weight of the catalyst support, and more preferably from about 70 percent by weight to about 90 percent by weight of the catalyst support for best results. The binder component can be alumina, silica, silica-alumina, clay, diatomaceous earth, or other binders known in the art.

Isomerization catalysts are generally prepared beginning with the support component. Where the support component comprises a molecular sieve such as mordenite, the sieve is generally employed in its acidic form. This is generally accomplished by ion-exchange of the alkali metals normally present in molecular sieves such as the as-synthesized zeolites. This ion-exchange can be accomplished using exchanging compounds including, but not limited to, ammonium nitrate, ammonium sulfate, dilute hydrochloric acid, and acetic acid. The molecular sieve component is generally combined with a binder component to form the catalyst support. Preferably, the binder component is mixed with the molecular sieve component in a paste, gel, slurry, or powder form prior to particle formation in order to improve the crush strength of the particles.

The catalytic metal component can be deposed or incorporated upon the support by impregnation employing heat-decomposable salts of the catalytic metal or other methods known to those skilled in the art such as ion-exchange, with impregnation methods being preferred. Where more than one catalytic metal is incorporated upon the support, the metals can be impregnated onto the support separately, or can be co-impregnated onto the support. Suitable impregnation solutions for the impregnation of platinum and/or palladium include, but are not limited to, chloroplatinic acid, palladium chloride, tetraamine palladium chloride, and tetraamine platinum chloride.

High temperature isomerization catalysts comprising a zeolitic support are preferred for use in processes where the feedstream can contain substantial levels of contaminants or where construction capital is particularly limited. While low temperature catalysts comprising an adsorptive carrier promoted with a halogen provide higher activity per weight of catalyst than high temperature catalysts, low temperature catalysts are substantially more sensitive to catalyst contaminants generally present in isomerization unit feedstocks. Low temperature catalysts are particularly sensitive to sulfur and water present in the feedstock. Moreover, low temperature catalysts can require higher capital and operating costs since low temperature processes generally utilize supplemental chloride-addition facilities which can be costly to construct. Supplemental chloride addition can also result in increased operating expenses from chloride-induced corrosion and heat exchanger fouling.

The hydrogenation catalyst suitable for use with the isomerization process of the present invention comprises a hydrogenation metal and a support component.

Suitable hydrogenation metals for use with the hydrogenation catalyst of the present invention are the noble metals and nickel, preferably the noble metals, more preferably the platinum group metals, and still more preferably platinum and palladium for best results. The hydrogenation metal can similarly comprise two or more hydrogenation metals selected from the group of suitable hydrogenation metals described hereabove. The hydrogenation metal can be present in the hydrogenation catalyst as an oxide or elemental metal. The hydrogenation metal is generally present in the hydrogenation catalyst in an amount ranging from about 0.01 percent by weight to about 5.0 percent by weight, preferably from about 0.1 percent by weight to about 2.0 percent by weight, and more preferably from about 0.2 percent by weight to about 1.0 percent by weight, calculated as a percentage of the hydrogenation catalyst and calculated as oxide.

The hydrogenation catalyst support component suitable for use in the hydrogenation catalyst of the present invention can comprise a refractory inorganic oxide support component, preferably alumina, silica, or the molecular sieves, and more preferably alumina and silica for best results. Where the refractory inorganic oxide support is alumina, the alumina is preferably an anhydrous gamma alumina or eta alumina.

Since there can be a large economic incentive to minimize hydrocracking and disproportionation of the hydrogenation reaction zone effluent to lighter hydrocarbons, the preferred hydrogenation catalyst support component has a particularly targeted cracking activity. A suitable method for measuring the cracking activity of a catalyst or support component is the alpha test which is described by P. B. Weisz and J. N. Miale in Superactive Crystalline Aluminosilicate Hydrocarbon Catalysts, Journal of Catalysis 4, 527–529 (1965) and by J. N. Miale, N. Y. Chen, and P. B. Weisz in Catalysis by Crystalline Aluminosilicates IV. Attainable Catalytic Cracking Rate Constants, and Superactivity, Journal of Catalysis 6, 278–287 (1966), which are hereby incorporated by reference. The alpha test method measures the activity of a catalyst or support component for promoting cracking reactions relative to a standard reference catalyst or support component. In the alpha test, normal hexane is cracked over the test catalyst at a particular set of process conditions and the reaction rate measured at one or more reaction temperatures. The alpha factor is defined as the ratio of the reaction rate of the test catalyst at the particular conditions hereabove to the reaction rate for the reference catalyst at the same conditions. The reference catalyst is a highly active conventional amorphous silica-alumina obtained by co-gellation, containing 10 percent alumina, and having a surface area of 420 $m^2$/gram and is defined as having an alpha factor of 1.0. The alpha factor is generally calculated at a temperature where a measurable level of cracking occurs. For purposes of the present invention, this temperature region ranges from about 800° F. to about 1000° F. Suitable hydrogenation catalyst supports for use with the hydrogenation catalyst of the present invention generally have an alpha factor of less than about 12.0, preferably less than about 10.0, and more preferably less than about 5.0 for best results.

The hydrogenation catalyst of the present invention is prepared in a manner similar to that described for the isomerization catalyst. Since the preferred hydrogenation support is generally alumina or silica, the primary catalyst preparation step is the incorporation of the catalytic metal. The catalytic metal component is similarly deposed or incorporated upon the support by impregnation employing heat-decomposable salts of the catalytic metal or other methods known to those skilled in the art such as ion-exchange, with impregnation methods being preferred.

A hydrogenation catalyst in accordance with the present invention can also comprise fresh or previously used reformer catalyst. Typical reforming catalyst generally comprises a noble catalytic metal on an inorganic oxide support such as alumina wherein the inorganic oxide support can comprise up to about 1 percent by weight chloride. By utilizing spent reforming catalyst that would otherwise be discarded or directed to a catalyst reclaimer at substantial expense, the refiner can reduce hydrogenation catalyst costs and further enhance the profitability of the process of the present invention.

The benzene hydrogenation and isomerization process of the present invention can begin with initial feed preparation steps. The feedstock can be subjected to a feedstock drying step. In this operation, all or part of the feedstock can be dried in a facility such as a regenerative molecular sieve dryer in order to extend catalyst life. The hydrogen that is introduced or recycled back to the isomerization process may also be dried. Molecular sieve isomerization catalysts can be particularly resistant to water deactivation and can tolerate water concentrations of as high as 250 ppm by weight. Preferably, the isomerization reactor feedstock water content is maintained below about 100 ppm by weight, and more preferably below about 50 ppm by weight for best results. Low temperature processes may require substantially lower water concentrations. Drying facilities, while essential in low temperature isomerization processes, are not always necessary for high temperature isomerization processes.

The feedstock is generally subjected to a feedstock desulfurization and denitrogenation step in a desulfurization and denitrogenation zone which is operated to remove the catalyst poisons described hereabove prior to introduction of the feedstock to the isomerization reactors. A catalyst comprising a hydrogenation-dehydrogenation component on a porous inorganic oxide support such as alumina, silica, or alumina-silica is generally used. Suitable hydrogenation components are base metals of groups VIA or VIIA of the Periodic Table (IUPAC) and usually will be a base metal or a combination of base metals, although noble metals such as platinum and palladium may be used. Examples of suitable base metals include molybdenum, nickel, cobalt, and tungsten, and combinations of base metals such as nickel-tungsten, cobalt-molybdenum, and nickel-tungsten-molybdenum. Desulfurization and denitrogenation process conditions comprise temperatures of from about 400° F. to about 800° F., pressures of from about 200 psig to about 1000 psig, and a hydrogen circulation rate of from about 300 SCF/Bbl to about 600 SCF/Bbl. A separation device such as a stripping tower is generally employed to facilitate removal of the catalyst poison components such as nitrogen and sulfur, in the form of ammonia and hydrogen sulfide, from the hydrotreater effluent. Suitable sulfur guard beds or adsorptive separation processes may also be used to reduce the sulfur concentration of the hydrotreater effluent or to provide precautionary protection against sulfur breakthrough which can occur during process upsets.

The feedstock is then generally subjected to isomerization in an isomerization reaction zone in the presence of hydrogen over a suitable isomerization catalyst such as those described hereabove. The reaction zone can comprise a single reaction vessel or one or more isomerization reactors in series combined with one or more reactors in parallel. A common reactor arrangement for commercial isomerization reaction zones is two reactors in parallel and two reactors in series. The isomerization reactors are commonly fixed bed types wherein the reactors can contain one or more beds of catalyst. Where multiple isomerization reactors or reactor beds are utilized, the reactors or reactor beds can similarly contain the same or different catalysts to perform the isomerization reaction.

The isomerization process reaction section of the present invention operates at elevated temperatures and pressures in the presence of hydrogen. Reaction temperatures, calculated as the average of a reactor bed inlet and outlet temperature, range from about 200° F. to about 650° F., preferably from about 250° F. to about 600° F., and more preferably from about 275° F. to about 550° F. for best results. Reaction pressures range from about 150 psig to about 800 psig, preferably from about 150 psig to about 650 psig, and more preferably from about 150 psig to about 500 psig for best results. Space velocities (WHSV) range from about 0.1 $hr^{-1}$ to about 10.0 $hr^{-1}$, preferably from about 0.5 $hr^{-1}$ to about 5.0 $hr^{-1}$ and more preferably from about 1.0 $hr^{-1}$ to about 2.0 $hr^{-1}$ for best results. Hydrogen circulation rates are commonly in the range of from about 200 SCF/Bbl of isomerization reactor feedstock to about 2000 SCF/Bbl and more preferably from about 500 SCF/Bbl of isomerization feedstock to about 1500 SCF/Bbl. Hydrogen partial pressure will generally comprise from about 40 percent to about 80 percent of the isomerization reactor pressure and is provided to reduce catalyst deactivation from coking.

The hydrogen stream can be pure hydrogen or can be in admixture with diluents such as hydrocarbon, and impurities such as carbon monoxide, carbon dioxide, nitrogen, water, sulfur compounds, and the like. The hydrogen stream purity should be at least about 50 percent by volume hydrogen, preferably at least about 65 percent by volume hydrogen, and more preferably at least 75 percent by volume hydrogen for best results. Hydrogen can be supplied from a hydrogen plant, a catalytic reforming facility, or other hydrogen producing processes.

The isomerization reaction zone effluent is then generally combined with a supplemental benzene-containing stream such as that described hereabove to form a hydrogenation zone feedstock. The supplemental benzene-containing stream may be passed through a suitable sulfur guard bed or adsorptive separation process prior to addition to the isomerization reaction zone effluent to reduce the sulfur concentration of the isomerization reaction zone effluent or to provide precautionary protection against sulfur breakthrough which can occur during process upsets prior to entering the hydrogenation reaction zone of the process.

The hydrogenation reaction zone feedstock is then generally subjected to a hydrogenation step wherein the benzene is saturated to produce a hydrogenation zone effluent comprising mostly cyclohexane and some methylcyclopentane in a hydrogenation reaction zone in the presence of hydrogen over a suitable hydrogenation catalyst such as those described hereabove. The reaction zone can consist of a single reaction vessel or one or more hydrogenation reactors in series and/or in parallel. Since benzene saturation occurs quickly, utilizing the hydrogenation catalyst described hereabove at hydrogenation conditions, one reactor is generally satisfactory for use with the present invention. The hydrogenation reactor is commonly a fixed bed type wherein the reactor can contain one or more beds of catalyst. Where multiple hydrogenation reactors or reactor beds are utilized, the reactors or reactor beds can similarly contain the same or different catalysts to perform the hydrogenation reaction. Similarly, interstage heat exchange can be performed to further optimize the process of the present invention.

The hydrogenation reaction zone of the present invention operates at elevated temperatures and pressures and in the presence of hydrogen. Reaction temperatures, calculated as the average of a reactor bed inlet and outlet temperature, range from about 150° F. to about 800° F., preferably from about 300° F. to about 650° F., and more preferably from about 400° F. to about 500° F. for best results. Reaction pressures range from about 150 psig to about 800 psig, preferably from about 150 psig to about 650 psig, and more preferably from about 150 psig to about 500 psig for best results. Space velocities (WHSV) range from about 0.5 $hr^{-1}$ to about 50.0 $hr^{-1}$, preferably from about 2.5 $hr^{-1}$ to about 25.0 $hr^{-1}$, and more preferably from about 5.0 $hr^{-1}$ to about 10.0 $hr^{-1}$ for best results. Hydrogen circulation rates are commonly in the range of from about 200 SCF/Bbl of hydrogenation reactor feedstock to about 2000 SCF/Bbl and more preferably from about 500 SCF/Bbl of hydrogenation reactor feedstock to about 1500 SCF/Bbl. Hydrogen partial pressure will generally comprise from about 40 percent to about 80 percent of the hydrogenation reactor pressure and is provided to reduce catalyst deactivation from coking.

The hydrogenation reaction zone of the process of the present invention hydrogenates benzene present crude paraffinic naphtha fractions and supplemental high benzene-content streams to levels less than 1.0 percent by weight as a percentage of an isomerization unit product, to levels less than 0.1 percent by weight as a percentage of an isomerization unit product, and to levels generally less than 0.05 percent by weight as a percentage of an isomerization unit product.

Feed forward benzene saturation exotherm control for the hydrogenation reaction zone can be implemented through process analyzers and manual intervention or automatically through computer software, in order to optimize the process and permit maximum benzene processing. Process analyzers, such as conventional on-line gas chromatographs, can be utilized to monitor the isomerization reaction zone effluent and the supplemental benzene-containing stream benzene concentration. This information, combined with the stream flow rates, can be utilized through a calculation step, to adjust the flow rate of the supplemental benzene-containing stream that the process can receive at a manageable hydrogenation reaction zone exotherm. Similarly, supplemental benzene-containing stream maximization can be managed by monitoring the hydrogenation reaction zone exotherm and controlling the flow rate of the supplemental benzene-containing stream to maintain a constant hydrogenation reaction zone exotherm. A more complex benzene maximization scheme that maximizes benzene processing yet reduces the risk of creating a temperature runaway condition can include feed forward control utilizing process analyzers and stream flowrates combined with exotherm temperature feedback that can override the feed forward system where hydrogenation reaction zone exotherms exceed a predetermined maximum. Other control systems for controlling or maximizing supplemental benzene-containing stream processing rates can be conceived, designed, and implemented based on the requirements of the individual refiner.

Further supplemental benzene-containing stream flow maximization can be obtained by utilizing a two-stage process of stream injection. Process control schemes can be developed as described hereabove for use as the first stage of benzene hydrogenation utilizing the hydrogenation reaction zone, not to exceed a predetermined hydrogenation reaction zone exotherm limit. Once the exotherm limit is met in the hydrogenation reaction zone, additional supplemental benzene-containing stream volumes can be added, as a second stage, to other steps in the isomerization process, including but not limited to upstream of the isomerization reaction zone and upstream of the desulfurization and denitrogenation zone. Supplemental benzene-containing stream injections to such zones are generally made at the processing cost penalties described hereabove (i.e. reduced isomerization conversion, catalyst coking, etc.), and efforts should be taken to minimize second stage additions.

Since both the isomerization and hydrogenation reactions are exothermic, interstage cooling, consisting of heat transfer devices between fixed bed reactors or between catalyst beds in the same reactor shell, can be employed. At least a portion of the heat generated from the isomerization and hydrogenation reactions can often be profitably recovered for use in other segments of the process of the present invention. Where this heat recovery option is not available, cooling can be performed through cooling utilities such as cooling water, air, or through use of a hydrogen quench stream injected directly into the isomerization and/or hydrogenation reactors. Similarly, the isomerization reaction zone effluent can be cooled by the addition of the cooler supplemental benzene-containing stream.

Control of the hydrogenation zone exotherm and, where applicable, the isomerization reaction zone exotherm, is particularly important to the profitable and safe operation of an isomerization process wherein benzene hydrogenation is performed. It has been found that for every 1 percent of benzene that is hydrogenated, a reaction zone exotherm of about 20° F. is created. Where the exotherm becomes substantial, caused either by particularly high concentrations of benzene in the supplemental benzene-containing stream or relatively high stream flowrates, exotherm control can become more difficult and less reliable. Small changes in the concentration of benzene, at high supplemental benzene-containing stream throughputs, can create drastic swings in the exotherm. Where exotherm swings become unstable, the risk of hydrocracking, also an exothermic reaction, becomes greater. Where thermal cracking occurs above and beyond the benzene saturation exotherm, the most effective process correction is a substantial reduction in the flow rate of the supplemental benzene-containing stream which reduces the benzene concentration of the hydrogenation reaction zone feedstock and subsequently, the hydrogenation zone exotherm.

Since the process of the present invention provides an isomerization reaction zone effluent comprising minimal benzene as a heat sink for absorbing the exotherm created from the supplemental benzene-containing stream, maximum concentrations of benzene can be managed at minimum exotherms. The process of the present invention can hydrogenate pure benzene present in the light naphtha feedstock and present in the supplemental benzene-containing stream in amounts ranging from about 0.1 percent to about 20.0 percent, calculated as a percentage of the isomerate product, while maintaining isomerization reaction zone and hydrogenation reaction zone exotherms each below 200° F. Preferably, hydrogenation of pure benzene present in the light naphtha feedstock and the supplemental benzene-containing stream is limited to from about 0.1 percent to about 15.0 percent, calculated as a percentage of the isomerate product, with the isomerization reaction zone and hydrogenation reaction zone exotherms each maintained below 150° F. More preferably, hydrogenation of pure benzene present in the light naphtha feedstock and the supplemental benzene-containing stream is limited to from about 0.1 percent to about 10.0 percent, calculated as a percentage of the isomerate product, with the isomerization reaction zone and hydrogenation reaction zone exotherms each maintained below 100° F. for best results. Where portions of the supplemental benzene-containing stream are added to the light naphtha feedstock, the same correlations and limitations for benzene concentration capacity and exotherm temperatures hold true utilizing the isomerization reaction zone feedstock, comprising any portions of the supplemental benzene-containing stream, in place of the light naphtha feedstock for purposes of the correlation hereabove.

Nevertheless, it is a preferred operational practice to maintain both the isomerization reaction zone and hydrogenation reaction zone exotherms at less than 200° F., preferably less than 150° F., and more preferably less than 100° F. for best results.

The hydrogenation zone effluent stream is generally cooled through conventional heat exchange equipment and the stream directed to a separator device to remove the hydrogen. Some of the recovered hydrogen can be recycled back to the process while some of the hydrogen is generally purged to external systems such as plant or refinery fuel. The hydrogen purge rate is generally controlled in order to maintain the minimum hydrogen purity described hereabove and to remove trace concentrations of hydrogen sulfide. Recycled hydrogen is generally compressed, supplemented with "make up" hydrogen, and reinjected into the process for further hydrogenation or isomerization.

In a once-through isomerization process, once the hydrogen has been removed from the hydrogenation zone effluent, the effluent product is generally directed to a product stabilizer or fractionator for the removal of light hydrocarbons that were introduced with the supplemental benzene-containing stream or were formed through hydrocracking in the isomerization or hydrogenation reaction zones.

Where the isomerization process is a recycle process, the effluent product is directed to a sorption zone, wherein normal hydrocarbons are separated from branched chain and cyclic hydrocarbons for recycling back to the isomerization reaction zone. The separation of normal hydrocarbons from branched chain and cyclic hydrocarbons is generally effected utilizing a solid sorbent. The preferred solid sorbents suitable for use in the process of the present invention are the molecular sieve type crystalline aluminosilicates. For example, one suitable crystalline aluminosilicate is a Type A zeolite manufactured by the Linde Division of Union Carbide. Zeolites may be characterized as having a porous structure, with the pores being interconnected by smaller diameter pore openings. When the pore openings are about 5 Å in diameter, normal hydrocarbons can enter the pores, but cyclic and branched chain hydrocarbons cannot enter because of their larger molecular diameters. When the effluent product comprising a mixture of normal paraffins, isoparaffins, and cyclics including, but not limited to cyclohexane and methylcyclopentane, is contacted with a zeolite of this type, the zeolite acts as a molecular sieve admitting normal hydrocarbons to the pores but excluding branched and cyclic hydrocarbons. The branched and cyclic hydrocarbons are then withdrawn from contact with the zeolite relatively free of normal hydrocarbons, and the normal hydrocarbons are subsequently desorbed from the zeolite.

A non-sorbable purge gas is generally used to flush the bed void space of vapors and carry from the bed desorbed normal paraffins. Bed void space, for purposes of this invention, shall mean any space in the bed not occupied by solid material except the intracrystalline cavities of the zeolite particles. Suitable non-sorbable purge gases for purposes of the present invention can be any permanent gas or mixture of gases which have molecular dimensions sufficiently small to enter the intracrystalline cavities of the molecular sieve, but are not themselves strongly enough adsorbed to displace normal hydrocarbons adsorbed thereon to any significant degree. Hydrogen, nitrogen, helium, and methane, and preferably hydrogen are preferred for use in the present invention. Desorbtion effectiveness can be improved by adsorbing the normal hydrocarbons at a higher pressure, and then desorbing them, utilizing the purge gas, at a lower pressure to create a vacuum effect. It is of little consequence that hydrogen purge gas is present in the normal paraffins recycled back to the isomerization zone since the isomerization reaction is conducted in the presence of hydrogen. Hydrogen present with the branched hydrocarbons and cyclics is generally separated through a flash separator downstream of the sorption zone. The product leaving the hydrogen separator is directed to the product stabilizer as described hereabove for the once-through isomerization process.

The recycle isomerization process is the preferred isomerization process and can produce an isomerate product comprising a volume fraction of branched isomers, calculated as a fraction of total isomerization unit product, of as high as 80 percent, as high as 85 percent, and often as high as 90 percent. High levels of isoparaffins in an isomerate product generally results in a gasoline component with superior octane.

The process of the present invention provides substantial benefits over prior methods for controlling benzene content in gasoline. The present process hydrogenates benzene present in crude paraffinic naphtha fractions and supplemental high benzene-content streams to levels less than 0.1 percent by weight as a percentage of an isomerization unit product and to levels generally less than 0.05 percent by weight as a percentage of an isomerization unit product. In this manner, benzene present in crude paraffinic naphtha and in supplemental benzene-containing streams such as those produced at catalytic reformers, fluid catalytic cracking units, and coking units, is cost-effectively converted to a more environmentally acceptable form. Moreover, the process can be conveniently retrofitted for use with most conventional isomerization unit designs including both low temperature and high temperature processes and once-through and recycle processes.

The present process achieves substantial benzene reduction wherein the benzene from supplemental benzene-containing streams does not significantly affect isomerization conversion or deactivate the isomerization reaction zone catalyst. This is achieved by positioning the benzene hydrogenation reaction zone downstream of the isomerization reaction zone and injecting supplemental benzene-containing streams downstream of the isomerization reaction zone and upstream of the hydrogenation reaction zone. In this manner, benzene from supplemental benzene-containing streams does not contact the isomerization catalyst prior to hydrogenation in the downstream hydrogenation reaction zone. As such, isomerization catalyst activity is preserved for converting normal paraffins to isoparaffins.

The present process permits control of benzene hydrogenation exotherms so as to reduce operability problems, excessive hydrocracking, and the occurrence of temperature runaway conditions. Benzene hydrogenation exotherms are controlled by hydrogenating the benzene from the crude paraffinic naphtha stream, which is generally present in low concentrations, in an isomerization reaction zone to create an isomerate product having minimal benzene. The isomerate product containing minimal benzene is then combined with a supplemental benzene-containing stream containing higher percentages of benzene, for hydrogenation in a hydrogenation reaction zone. In this manner, the isomerate product provides an exotherm heat sink of known volume and composition (i.e. containing minimal benzene) for combining with the supplemental benzene-containing stream which can be more likely to vary in composition and volume. The rate of supplemental benzene-containing stream addition can be accurately adjusted to control temperature exotherms within an operating range to ensure that such exotherms do not cause operability problems, excessive hydrocracking, or a temperature runaway condition.

The present process permits the processing of higher supplemental benzene-containing stream benzene concentrations and volumes at a constant and controllable exotherm temperature than prior art processes. This results from the hydrogenation of benzene contained in the crude paraffinic naphtha fractions, which is generally provided in low concentrations, in an isomerization reaction zone prior to hydrogenation of higher benzene content supplemental benzene-containing streams. Higher benzene concentrations and volumes of the supplemental benzene-containing stream can be processed since the product leaving the isomerization zone and utilized as the heat sink for absorbing the exotherm contains minimal benzene. Additionally, the benzene concentration and volume of the isomerization zone product is generally known and permits increased supplemental benzene-containing stream processing capacity through improved process control. Moreover, the process permits benzene hydrogenation to take place in the isomerization reaction zone and the hydrogenation reaction zone which substantially increases benzene hydrogenation capacity.

The present process results in a significant increase in the volume yield of gasoline. The hydrogenation of benzene results in a weight gain from conversion of benzene to components such as cyclohexane, methylcyclopentane, and hexane isomers. Moreover, cyclohexane, methylcyclopentane, and hexane isomers have a substantially lower density than benzene, resulting in further volume yield advantages. Overall, the relative volume expansions for cyclohexane, methylcyclopentane, and hexane isomers over benzene are 22 percent, 27 percent, and 47 percent respectively. Where a supplemental benzene-containing stream comprises 10 percent benzene, volume expansion of the hydrogenation products of the benzene-containing stream as a percentage of the volume of the supplemental benzene-containing stream is generally greater than 2 percent and generally greater than 2.5 percent.

The present process, when utilized with a recycle isomerization process, provides normal paraffin separation and recycle steps that substantially improve normal to isoparaffin conversion. Normal paraffins that are not converted to isoparaffins from the crude paraffinic naphtha and normal paraffins from the supplemental benzene-containing stream can be separated downstream of the hydrogenation zone and recycled back to the isomerization zone for isomerization to higher octane isomers. In this manner, the process of the present invention provides maximum isomerization capability and produces a product containing minimal benzene.

That which is claimed is:

1. A process for the hydrogenation of benzene and the isomerization of a light naphtha feedstock consisting essentially of a stream having a boiling range of from about 50° F. to about 240° F., comprising:

contacting said light naphtha feedstock at isomerization conditions in an isomerization reaction zone comprising an isomerization reaction zone temperature ranging from about 200° F. to about 650° F. and a pressure ranging from about 150 psig to about 800 psig with an isomerization catalyst in the presence of hydrogen and producing an isomerization reaction zone effluent;

combining said isomerization reaction zone effluent with a supplemental benzene-containing stream, said supplemental benzene-containing stream comprising at least 1 weight percent benzene, and forming a hydrogenation zone feedstock; and hydrotreating said hydrogenation zone feedstock at hydrogenation conditions in a hydrogenation reaction zone with a hydrogenation catalyst in the presence of hydrogen for producing an isomerate product comprising less than 0.1 weight percent benzene.

2. The process of claim 1 wherein said light naphtha feedstock comprises at least 85 weight percent aliphatic hydrocarbons having from 5 to 6 carbon atoms and at least 1 weight percent benzene.

3. The process of claim 1 wherein said isomerization catalyst comprises a platinum group catalytic metal component and an inorganic oxide support selected from the group consisting of alumina, silica, and the molecular sieves.

4. The process of claim 3 wherein said inorganic oxide support comprises a molecular sieve selected from the group consisting of mordenite, Y-zeolite, and beta zeolite.

5. The process of claim 1 wherein said isomerization conditions comprise an average isomerization reaction zone operating temperature of from about 250° F. to about 600° F., an operating pressure of from about 150 psig to about 650 psig, and a space velocity of from about 0.5 WHSV ($hr^{-1}$) to about 5.0 WHSV ($hr^{-1}$).

6. The process of claim 1 wherein said hydrogenation catalyst comprises a Group VIII catalytic metal and an inorganic oxide support, said inorganic oxide support having an alpha test factor of less than about 12.0.

7. The process of claim 1 wherein said hydrogenation conditions comprise an average hydrogenation reaction zone operating temperature of from about 300° F. to about 650° F., an operating pressure of from about 150 psig to about 650 psig, and a space velocity of from about 2.5 WHSV ($hr^{-1}$) to about 25.0 WHSV ($hr^{-1}$).

8. The process of claim 1 wherein said isomerization reaction zone and said hydrogenation reaction zone each comprise a reaction zone inlet and a reaction zone outlet and the temperature exotherm from each respective inlet to each respective outlet is less than 150° F. for each reaction zone.

9. The process of claim 8 wherein at least a portion of said supplemental benzene-containing stream is injected into said isomerization reaction zone.

10. The process of claim 1 wherein said supplemental benzene-containing stream comprises at least 3.0 weight percent benzene.

11. The process of claim 1 wherein said supplemental benzene-containing stream comprises at least one member selected from the group consisting of product derived from a catalytic reforming process, product derived from a fluid catalytic cracking process, product derived from a coking process, and a benzene precursor stream derived from crude.

12. The process of claim 1 wherein the volume of pure benzene entering said process with said light naphtha feedstock and with said supplemental benzene-containing stream as a percentage of the isomerate product, ranges from about 0.1 percent to about 20.0 percent.

13. The process of claim 8 wherein the volume of pure benzene entering said process with said light naphtha feedstock and with said supplemental benzene-containing stream as a percentage of the isomerate product, ranges from about 0.1 percent to about 15.0 percent.

14. A process for the hydrogenation of benzene and the isomerization of a light naphtha feedstock consisting essentially of a stream having a boiling range of from about 50° F. to about 240° F., comprising:

contacting said light naphtha feedstock at isomerization conditions in an isomerization reaction zone comprising an isomerization reaction zone temperature ranging from about 200° F. to about 650° F. and a pressure ranging from about 150 psig to about 800 psig with an isomerization catalyst in the presence of hydrogen and producing an isomerization reaction zone effluent substantially comprising normal paraffins and isoparaffins and less than 0.1 weight percent benzene;

combining said isomerization reaction zone effluent with a supplemental benzene-containing stream, said supplemental benzene-containing stream comprising at least 1 weight percent benzene, and forming a hydrogenation zone feedstock substantially comprising normal paraffins, benzene, and isoparaffins;

hydrotreating said hydrogenation zone feedstock at hydrogenation conditions in a hydrogenation reaction zone with a hydrogenation catalyst in the presence of hydrogen and producing a hydrogenation reaction zone effluent comprising normal paraffins, cycloparaffins, and isoparaffins and less than about 0.1 weight percent benzene;

separating said hydrogenation reaction zone effluent into a recycle stream substantially comprising normal paraffins and an isomerate product stream substantially comprising cycloparaffins and isoparaffins; and recycling said recycle stream back to said isomerization reaction zone.

15. The process of claim 14 wherein said light naphtha feedstock comprises at least 85 weight percent aliphatic hydrocarbons having from 5 to 6 carbon atoms and at least 1 weight percent benzene.

16. The process of claim 14 wherein said isomerization catalyst comprises a platinum group catalytic metal component and a support component comprising at least one member selected from the group consisting of alumina, silica, and the molecular sieves.

17. The process of claim 14 wherein said isomerization conditions comprise an average isomerization reaction zone operating temperature of from about 250° F. to about 650° F., an operating pressure of from about 150 psig to about 650 psig, and a space velocity of from about 0.5 WHSV ($hr^{-1}$) to about 5.0 WHSV ($hr^{-1}$).

18. The process of claim 14 wherein said hydrogenation catalyst comprises a noble metal catalytic metal on a support comprising at least one member selected from the group consisting of alumina, silica, and the molecular sieves, said hydrogenation catalyst having an alpha test factor of less than about 10.0.

19. The process of claim 14 wherein said hydrogenation conditions comprise an average hydrogenation reaction zone operating temperature of from about 300° F. to about 650° F., an operating pressure of from about 150 psig to about 650 psig, and a space velocity of from about 2.5 WHSV ($hr^{-1}$) to about 25.0 WHSV ($hr^{-1}$).

20. The process of claim 14 wherein said isomerization reaction zone and said hydrogenation reaction zone each comprise a reaction zone inlet and a reaction zone outlet and the temperature exotherm from each respective inlet to each respective outlet is less than 150° F. for each reaction zone.

21. The process of claim 14 wherein at least a portion of said supplemental benzene-containing stream is injected into said isomerization reaction zone.

22. The process of claim 14 wherein said supplemental benzene-containing stream comprises at least 5.0 weight percent benzene.

23. The process of claim 14 wherein the volume of pure benzene entering said process with said light naphtha feedstock and with said supplemental benzene-containing stream as a percentage of the isomerate product, ranges from about 0.1 percent to about 20.0 percent.

24. The process of claim 20 wherein the volume of pure benzene entering said process with said light naphtha feedstock and with said supplemental benzene-containing stream as a percentage of the isomerate product, ranges from about 0.1 percent to about 15.0 percent.

25. A process for the hydrogenation of benzene and the isomerization of a light naphtha feedstock consisting essentially of a stream having a boiling range of from about 50° F. to about 240° F. and containing at least 1 weight percent benzene, comprising:

contacting said light naphtha feedstock at isomerization conditions in an isomerization reaction zone comprising an isomerization reaction zone temperature ranging from about 200° F. to about 650° F. and a pressure ranging from about 150 psig to about 800 psig with an isomerization catalyst in the presence of hydrogen and producing an isomerization reaction zone effluent substantially comprising hydrogen, normal paraffins, isoparaffins, and less than about 0.1 weight percent benzene;

combining said isomerization reaction zone effluent with a supplemental benzene-containing stream, said supplemental benzene-containing stream comprising at least 3 weight percent benzene, and forming a hydrogenation zone feedstock substantially comprising hydrogen, benzene, normal paraffins, and isoparaffins;

hydrotreating said hydrogenation zone feedstock at hydrogenation conditions in a hydrogenation reaction zone with a hydrogenation catalyst in the presence of hydrogen and producing a hydrogenation reaction zone effluent substantially comprising hydrogen, cycloparaffins, normal paraffins, isoparaffins, and less than 0.1 weight percent benzene;

separating said hydrogenation reaction zone effluent into a recycle stream comprising normal paraffins and an isomerate product stream substantially comprising hydrogen, cycloparaffins, and isoparaffins;

recycling said recycle stream back to said isomerization reaction zone; and fractionating said isomerate product stream into a stream comprising hydrogen and a stabilized isomerate product.

26. The process of claim 25 wherein said light naphtha feedstock comprises at least 90 weight percent aliphatic hydrocarbons having from 5 to 6 carbon atoms and at least 1 weight percent benzene.

27. The process of claim 25 wherein said isomerization catalyst comprises a catalytic metal component comprising platinum and a support component comprising at least one member selected from the group consisting of alumina and the zeolites.

28. The process of claim 25 wherein said isomerization conditions comprise an average isomerization reaction zone operating temperature of from about 275° F. to about 550° F., an operating pressure of from about 150 psig to about 500 psig, and a space velocity of from about 1.0 WHSV ($hr^{-1}$) to about 2.0 WHSV ($hr^{-1}$).

29. The process of claim 25 wherein said hydrogenation catalyst comprises a Platinum Group catalytic metal on a support comprising at least one member selected from the group consisting of alumina and silica, said hydrogenation catalyst having an alpha test factor of less than about 5.0.

30. The process of claim 25 wherein said hydrogenation conditions comprise an average hydrogenation reaction zone operating temperature of from about 400° F. to about 500° F., an operating pressure of from about 150 psig to about 500 psig, and a space velocity of from about 5.0 WHSV ($hr^{-1}$) to about 10.0 WHSV ($hr^{-1}$).

31. The process of claim 25 wherein said isomerization reaction zone and said hydrogenation reaction zone each comprise a reaction zone inlet and a reaction zone outlet and the temperature exotherm from each respective inlet to each respective outlet is less than 100° F. for each reaction zone.

32. The process of claim 25 wherein at least a portion of said supplemental benzene-containing stream is injected into said isomerization reaction zone.

33. The process of claim 25 wherein said supplemental benzene-containing stream comprises at least 5.0 weight percent benzene.

34. The process of claim 25 wherein the volume of pure benzene entering said process with said light naphtha feedstock and with said supplemental benzene-containing stream as a percentage of the isomerate product, ranges from about 1.0 percent to about 20.0 percent.

35. The process of claim 31 wherein the volume of pure benzene entering said process with said light naphtha feedstock and with said supplemental benzene-containing stream as a percentage of the isomerate product, ranges from about 1.0 percent to about 10.0 percent.

* * * * *